US008451918B1

(12) United States Patent
Cheng et al.

(10) Patent No.: US 8,451,918 B1
(45) Date of Patent: May 28, 2013

(54) SYSTEM AND METHOD FOR SPUR ESTIMATION AND MITIGATION

(75) Inventors: Hao-Ren Cheng, Yuanli Township (TW); Gaspar Lee, Bade City (TW); William J. McFarland, Los Altos, CA (US); Paul J. Husted, San Jose, CA (US); Justin Huang, Hsinchu (TW)

(73) Assignee: QUALCOMM Incorporated, San Diego, CA (US)

( * ) Notice: Subject to any disclaimer, the term of this patent is extended or adjusted under 35 U.S.C. 154(b) by 953 days.

(21) Appl. No.: 12/272,629

(22) Filed: Nov. 17, 2008

(51) Int. Cl.
*H04K 1/10* (2006.01)

(52) U.S. Cl.
USPC ..... 375/260; 370/208; 455/130

(58) Field of Classification Search
None
See application file for complete search history.

(56) References Cited

U.S. PATENT DOCUMENTS

2002/0186796 A1* 12/2002 McFarland et al. ..... 375/341
2005/0059366 A1* 3/2005 Choi et al. ..... 455/130
2007/0153878 A1* 7/2007 Filipovic ..... 375/147
2007/0291636 A1* 12/2007 Rajagopal et al. ..... 370/208
2008/0101212 A1* 5/2008 Yu et al. ..... 370/208
2009/0096514 A1* 4/2009 Xu et al. ..... 327/551
2009/0316667 A1* 12/2009 Hirsch et al. ..... 370/338

* cited by examiner

*Primary Examiner* — Leon-Viet Nguyen

(74) *Attorney, Agent, or Firm* — Bever, Hoffman & Harms, LLP

(57) ABSTRACT

A spur detection and spur cancellation apparatus in a multiple sub-carrier digital communication receiver includes a spur detection block that estimates, using one or more Fourier transforms, a frequency location of a narrowband interference spur in a received digital signal that includes a plurality of sub-carriers, and a spur cancellation block that attenuates the estimated narrowband interference spur. The spur detection block may use a fast Fourier transform (FFT) and/or a discrete Fourier transform (DFT) to locate a frequency and to measure a discrete power spectra of the narrowband interference spur. A channel state information block in the receiver may adjust a channel state information metric based on the located frequency and/or the measured discrete power spectra of the narrowband interference spur.

16 Claims, 5 Drawing Sheets

SYSTEM AND METHOD FOR SPUR ESTIMATION AND MITIGATION

BACKGROUND OF THE INVENTION

1. Field of the Invention

Embodiments of the present invention generally relate to digital communication systems that use multiple sub-carriers, and more particularly to systems and methods to detect and mitigate the effect of spurs in received sub-carriers in such systems, thereby improving system performance.

2. Description of the Related Art

Digital communication systems that use multiple sub-carriers are becoming increasingly prevalent in order to offer good performance under varying noise conditions. For example the IEEE 802.11 wireless standards employ a method known as Orthogonal Frequency Division Multiplexing (OFDM) to address multipath and other transmission impairments, and several ITU-T digital subscriber line (DSL) standards employ a similar method known as Discrete Multitone (DMT) to counter inter-symbol interference and other additive noises.

In an OFDM or DMT multiple sub-carrier system, a higher rate data signal may be divided among multiple narrowband sub-carriers that are orthogonal to one another in the frequency domain. The higher rate data signal may be transmitted as a set of parallel lower rate data signals each carried on a separate sub-carrier. In a wireless system, multipath may cause multiple versions of a transmitted data signal to arrive at a receiver with different delays, thereby resulting in inter-symbol interference created by received energy from different data signals transmitted at different times arriving at the receiver simultaneously. Each lower rate sub-carrier's symbol in an OFDM or DMT system may occupy a longer symbol period than in a higher rate single carrier system, and thus dispersion caused by multipath may be substantially contained within the longer symbol period, thereby reducing inter-symbol interference.

While a multiple sub-carrier system may transmit a set of symbols in parallel orthogonally, intervening transmission impairments may affect the orthogonality of the received sub-carrier symbols. To determine the effect of the transmission channel and impairments on receiver performance, the multiple sub-carrier system may use a set of training symbols to estimate the channel and noise. Subsequent data symbols, after the training symbols, may also be used to update the channel and noise estimates. The symbols received on each sub-carrier may be modified by the channel and noise estimates to improve detection and decoding performance.

To maintain time synchronization between the transmitter and the receiver in a multiple sub-carrier system, a number of sub-carriers, also known as "pilot" sub-carriers, may transmit a pre-determined pattern. Which specific sub-carriers are used for pilots may be fixed or may vary over time. For example, in an 802.11 system, four of the 52 orthogonal sub-carriers are dedicated as "pilot" subcarriers; while in an ISDB-T digital TV system, a number of sub-carriers are used to transmit "pilot" symbols at regular intervals and transmit data symbols at other times.

Narrowband noise impairments, also called spurs, on the "pilot" sub-carriers may affect the time synchronization recovery in the receiver and thereby may affect system performance, while spurs on the "data" sub-carriers may affect decoding of the data by the receiver. In some systems, the presence and location of a narrowband interferer may be known a priori, as described in U.S. Pat. No. 7,321,631 assigned to Atheros Communications and incorporated by reference herein. For example, a system's reference oscillator may create harmonics at odd and even multiples of the reference frequency that may couple into and adversely affect the performance of a communication system's receiver. By examining how a noise spur may affect information transmitted on a set of sub-carriers, a metric may be associated with each sub-carrier prior to using symbols received in those sub-carriers for time synchronization or data decoding. One such metric known as "channel state information" (CSI) may determine a weighting given to bits of a received symbol on a sub-carrier based on the transmitted data rate for that subcarrier, and/or on the estimated channel response, and/or on the measured noise on that sub-carrier. The weightings given to bits on sub-carriers adjacent to a sub-carrier containing significant channel attenuation or additive noise may also be adjusted. A Viterbi decoder may then use the CSI metric to "weight" its decoding decisions by de-emphasizing data received on sub-carriers with significant attenuation or measured noise. Similarly a timing synchronization routine may de-emphasize or ignore the information on pilot sub-carriers containing significant attenuation or measured noise.

In many systems the location of narrowband interference may not be known in advance or may vary during transmission, so a method to detect adaptively the presence and location of such spurs and mitigate their effects to improve system performance in communication systems using multiple sub-carriers is needed.

SUMMARY OF THE INVENTION

A spur detection and spur cancellation apparatus in a multiple sub-carrier digital communication receiver includes a spur detection block that estimates, using one or more Fourier transforms, a frequency location of a narrowband interference spur in a received digital signal that includes a plurality of sub-carriers, and a spur cancellation block that attenuates the estimated narrowband interference spur. The spur detection block may use a fast Fourier transform (FFT) and/or a discrete Fourier transform (DFT) to locate a frequency and to measure a set of discrete power spectra of the narrowband interference spur. A channel state information block in the receiver may adjust a channel state information metric based on the located frequency and/or the measured discrete power spectra of the narrowband interference spur.

DETAILED DESCRIPTION

Figure 1:
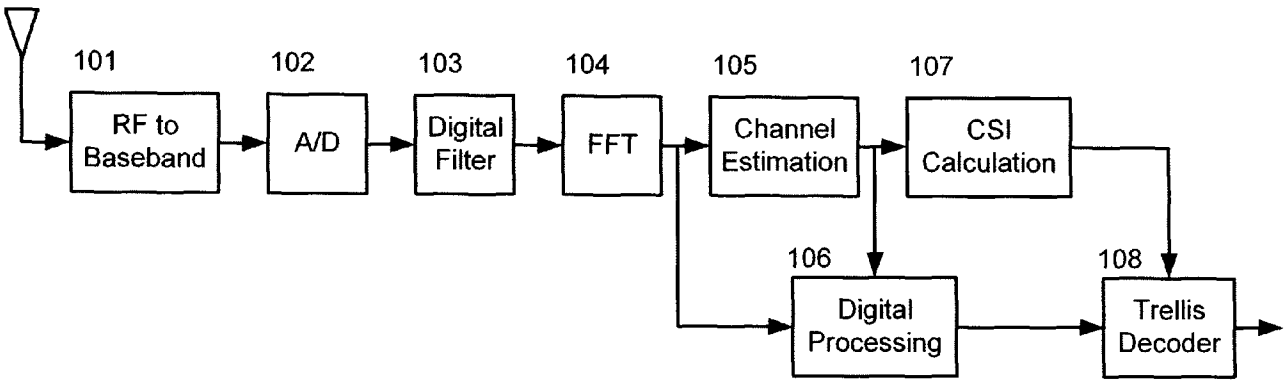
Figure 1 (Prior Art)
FIG. 1 illustrates a prior art wireless multiple sub-carrier receiver that includes Viterbi decoding with channel state information (CSI).

FIG. 1 illustrates basic elements of a prior art wireless receiver that uses multiple sub-carriers to transmit data and calculates a channel state information to modify Viterbi decoding of a received signal. A wireless OFDM signal received by an antenna may be down converted from radio frequencies (RF) to baseband frequencies by a down conversion block 101. The resulting baseband signal may be sampled by an analog to digital converter (A/D) 102 and then processed by a digital filter 103 to limit the received signal to a specific frequency band thereby limiting the influence of interference from frequencies outside of the main transmission band. The digital filter 103 may also down sample the received signal to a rate that matches the input used for a subsequent FFT block 104. The resulting digitally filtered signal may then be processed by the FFT block 104 that may also remove a cyclic prefix added at the transmitter to each OFDM symbol as a guard interval. For each received OFDM symbol, the set of outputs from the FFT block 104 may provide a set of noisy received complex-valued symbols that may be represented as $$Y_k=H_kX_k+N_k \tag{1}$$

for each of the k different sub-carriers, where $H_k$ may represent a complex valued channel response that modifies a complex valued transmit symbol $X_k$ on sub-carrier k and $N_k$ may represent the additive interference (noise) on sub-carrier k.

The set of outputs from the FFT block 104 may be input to a channel estimation block 105 to determine, for each sub-carrier, a change in both amplitude and phase that the channel may induce on a transmitted symbol. A channel estimate for sub-carrier k, which may be designated as $\hat{H}_k$, may be calculated using pre-determined training symbols initially and may be updated using subsequent random data symbols. Other methods for calculating a sub-carrier channel's estimate may also be used. Using the estimated channel response $\hat{H}_k$ and the received symbol $Y_k$, an estimated transmit symbol $\hat{X}_k$ may be calculated using a number of known methods in a digital processing block 106. One example method may calculate a zero-forcing estimate of the transmit symbol as $$\hat{X}_k = \frac{\hat{H}_k^*}{|\hat{H}_k|^2} Y_k \tag{2}$$

where $\hat{H}_k^*$ may denote the complex conjugate of the complex-valued channel estimate $\hat{H}_k$.

The estimated transmit symbol $\hat{X}_k$ may be input to a forward error correction decoder, such as a trellis decoder block 108. As the quality of an estimated transmit symbol $\hat{X}_k$ may depend on the quality of the estimated channel response $\hat{H}_k$, the trellis decoder block 108 may accept a set of metrics known as "channel state information" (CSI) that may be based on the estimated channel response $\hat{H}_k$ for each of the sub-carriers. In some embodiments, the CSI may be based on a power spectrum of the estimated channel response $|\hat{H}_k|^2$; while in other embodiments, the CSI may be based on an amplitude of the estimated channel response $|\hat{H}_k|$. For sub-carriers that may significantly attenuate the transmit signal, i.e. when $|\hat{H}_k|^2$ or $|\hat{H}_k|$ may be relatively small, the trellis decoder 108 may de-emphasize the estimated transmit symbols from those sub-carriers, as they may be less reliable when decoding the estimated transmit symbols.

Figure 2:
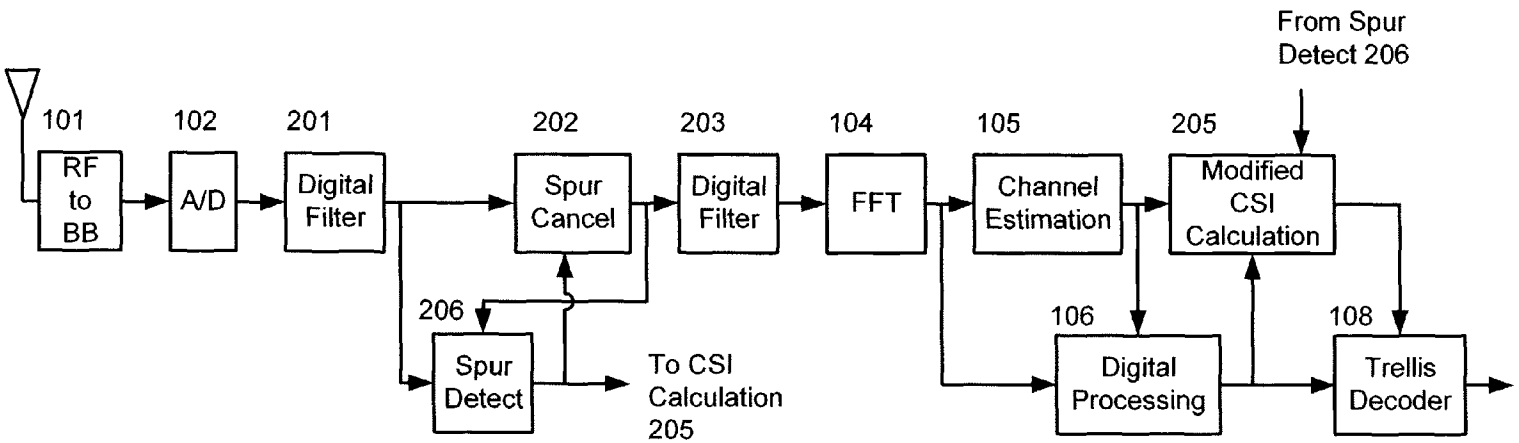
FIG. 2 illustrates a wireless multiple sub-carrier receiver that includes adaptive spur detection and cancellation with Viterbi decoding using modified CSI calculations.

FIG. 2 illustrates an improved wireless receiver including adaptive spur detection that may be used for spur cancelation and for modifying channel state information prior to Viterbi decoding. Following RF to baseband (BB) conversion 101 of a wireless signal received by an antenna and subsequent analog to digital conversion 102, a received digital signal may be filtered to remove out of band interference as well as down sampled by a digital filter 201 to a rate matched for input to a spur detection block 206. The spur detection block 206 may process the received digital signal to determine the presence and location of one or more narrowband interferers (spurs). Information about the location and level of the spurs may be communicated to a spur cancellation block 202 as well as to a "channel state information" calculation block 205. The spur cancellation block 202 may attenuate one or more of the spurs in the received digital signal, and the output of the spur cancellation block 202 may be fed back into the spur detection block 206 to form a closed loop for adaptive detection of the spurs. The output of the spur cancellation block 202 may also be processed by a digital filter prior to input to the FFT block 104, which transforms the time domain samples into a set of complex-valued frequency domain symbols, one symbol for each sub-carrier. Following a digital processing block 106, the received symbols may be decoded by a trellis (Viterbi) decoder that uses supplemental "channel state information" provided by a modified CSI calculation block 205. Information about the location and level of spurs from the spur detection block 206 may adjust the values in the CSI. Details of the spur detection, cancellation and modified CSI are presented below.

Figure 3:
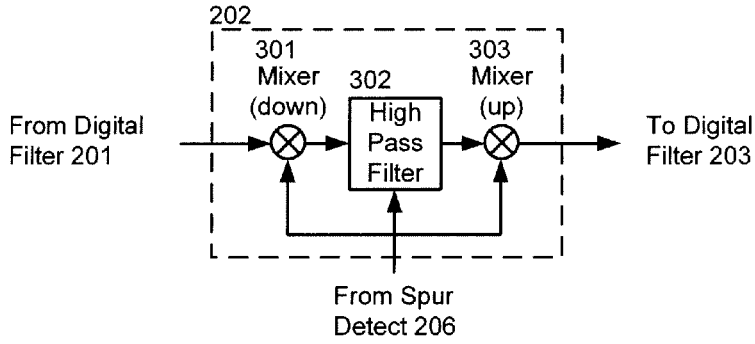
FIG. 3 illustrates an embodiment of an adaptive spur cancellation block of FIG. 2.

FIG. 3 illustrates an embodiment of the spur cancellation block 202 which may receive a digitally filtered signal from the digital filter block 201 and information about the location of spurs from the spur detection block 206. The spur cancellation block 202 may include a mixer 301 that may shift the digitally filtered signal down in frequency to align the detected spur at (or near) DC. A high pass filter 302 may then attenuate signals at (and near) DC to remove the narrowband interference spur. The high pass filtered signal may then be up shifted in frequency by a second mixer 303 back to the original frequency range occupied by the signal when input to the spur cancellation block 202. Other embodiments of a spur cancellation block may be used, such as a single or multiple notch filter at or near the detected narrowband interference spur frequencies.

Figure 4:
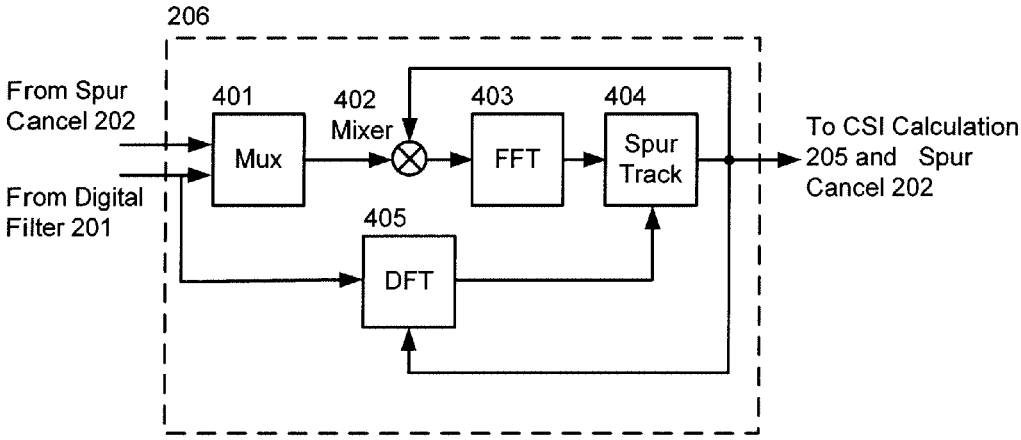
FIG. 4 illustrates an embodiment of an adaptive spur detection block of FIG. 2.
Figure 7A:
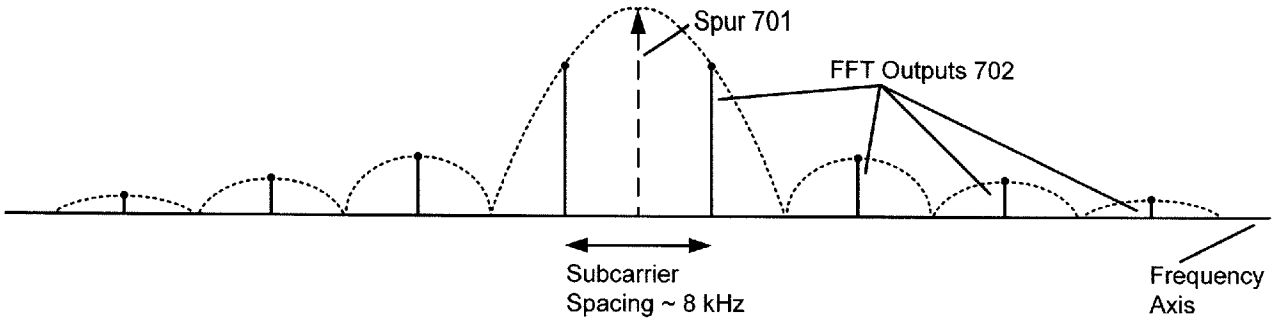
FIG. 7A illustrates a set of power spectrum values for FFT outputs of a narrowband interference spur occurring at a frequency between FFT sub-carriers.
Figure 7B:
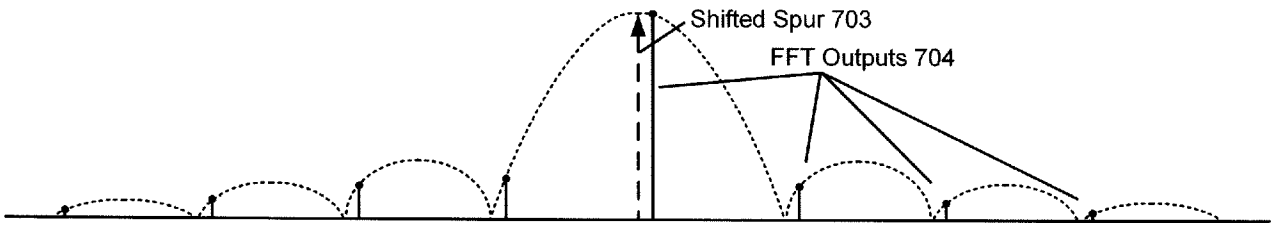
FIG. 7B illustrates a set of power spectrum values for FFT outputs of a narrowband interference spur shifted closer to a frequency of an FFT sub-carrier.

FIG. 4 illustrates an embodiment of the spur detection block 206 that may receive a digital signal prior to or after processing by the spur cancellation block 202. During spur detection or tracking the digital signal with and without spur cancellation may be compared by the spur detection block 206 to ensure the effectiveness of the spur detection and cancellation operations. A multiplexer 401 may choose either signal that may then be shifted by a mixer 402 prior to conversion from the time domain to the frequency domain by an FFT block 403. (Note in some embodiments, the FFT block 403 may use the same circuitry as the FFT block 104 to conserve silicon area.) The mixer may receive an input also from a spur tracking block 404 that may provide an indication of how much to shift the signal to locate the spur. Initially with no information about spur location and with no attendant shift by the mixer 402, the output of the FFT block 403 may be examined by a spur tracking block 404 for the presence of narrowband interferers. If the narrowband interferer's center frequency is on or near one of the sub-carrier frequencies, the power spectrum for that sub-carrier averaged over a number of OFDM symbols may be substantially higher than for other neighboring sub-carriers. If the narrowband interferer's center frequency is between two of the sub-carrier frequencies, the power spectrum received in the adjacent sub-carriers may be similar. As shown in FIG. 7A, a narrowband interference spur 701 centered between two sub-carriers may result in near equal values on the sub-carrier outputs 702 for the frequencies surrounding the spur 701. To locate the center frequency of the spur 701 more accurately, the mixer 402 may shift its input signal by a fraction of the sub-carrier spacing prior to transformation by the FFT block 403. FIG. 7B illustrates an output of the FFT block 403 for a shifted spur 703. The power spectrum values in the FFT outputs 704 may result in a single larger sub-carrier value that more clearly locates the center frequency of the shifted narrowband interference spur 703.

Figure 8:
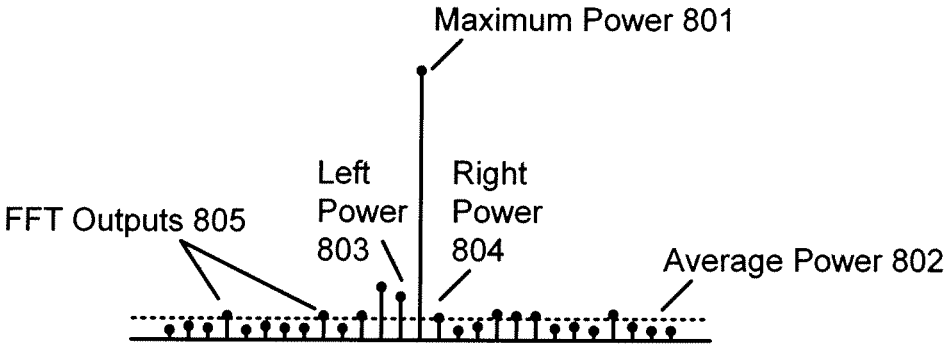
FIG. 8 illustrates a set of power spectrum values for FFT outputs to assist in narrowband interference spur detection.

In some embodiments, when acquiring an initial estimate of the frequency of the spur 701, the mixer 402 may shift the input signal by multiple values; for example the mixer 402 may shift the signal by an equally spaced fraction of the sub-carrier spacing {0, 1/N, 2/N, . . . (N−2)/N, (N−1)/N}× "sub-carrier frequency spacing." In a system with a sub-carrier spacing of 4 kHz, the mixer 402 may shift by the input signal by up to 32 different values, namely {0 Hz, 4 kHz/32=125 Hz, 4 kHz*2/32=250 Hz, . . . , 4 kHz*31/32=3875 Hz}. The FFT 403 outputs for each of the sub-carriers may be averaged over multiple OFDM symbols for each of the different frequency shift values. The spur tracking block 404 may then determine a frequency shift value that best locates the center of a spur frequency by testing each sub-carrier's averaged value. FIG. 8 illustrates some example test criteria. In some embodiments, the value of a sub-carrier with a maximum power 801 may be compared against an average power level 802 of all of the received sub-carriers. If the maximum power 801 exceeds the average power 802 by a pre-determined threshold, e.g. 12 dB, the frequency of the sub-carrier with the maximum power 801 may contain a narrowband interference spur. In another embodiment, the value of the sub-carrier with the maximum power 801 may be compared against the power of two adjacent sub-carriers. If the maximum power 801 of a sub-carrier exceeds a "left" power 803 of an adjacent lower frequency sub-carrier and exceeds a "right" power 803 of an adjacent higher frequency sub-carrier by a second pre-determined threshold, e.g. 6 dB, a narrowband interference spur may be detected at the center sub-carrier.

While the system described above may provide a coarse estimate for the center frequency of a spur, a finer estimate of the spur may be desired. Increasing the size of the FFT 403 may result in more closely spaced sub-carriers, or increasing the number N of discrete frequency shifts used by the mixer 402, may provide a finer estimate of the spur frequency at the expense of increased computation and storage. In some embodiments, an efficient fine estimate of the spur center frequency may be determined using a separate DFT block 405 that accepts as an input a digital signal output from the digital filter 201, i.e. the received digital signal before spur cancellation, and also receives information from the spur tracking block 404, for example a coarse estimate of the spur's center frequency. The DFT block may then calculate outputs at a set of frequencies narrowly surrounding a spur's coarse frequency estimate from which a fine frequency estimate of a narrowband interference spur may be obtained.

Figure 6:
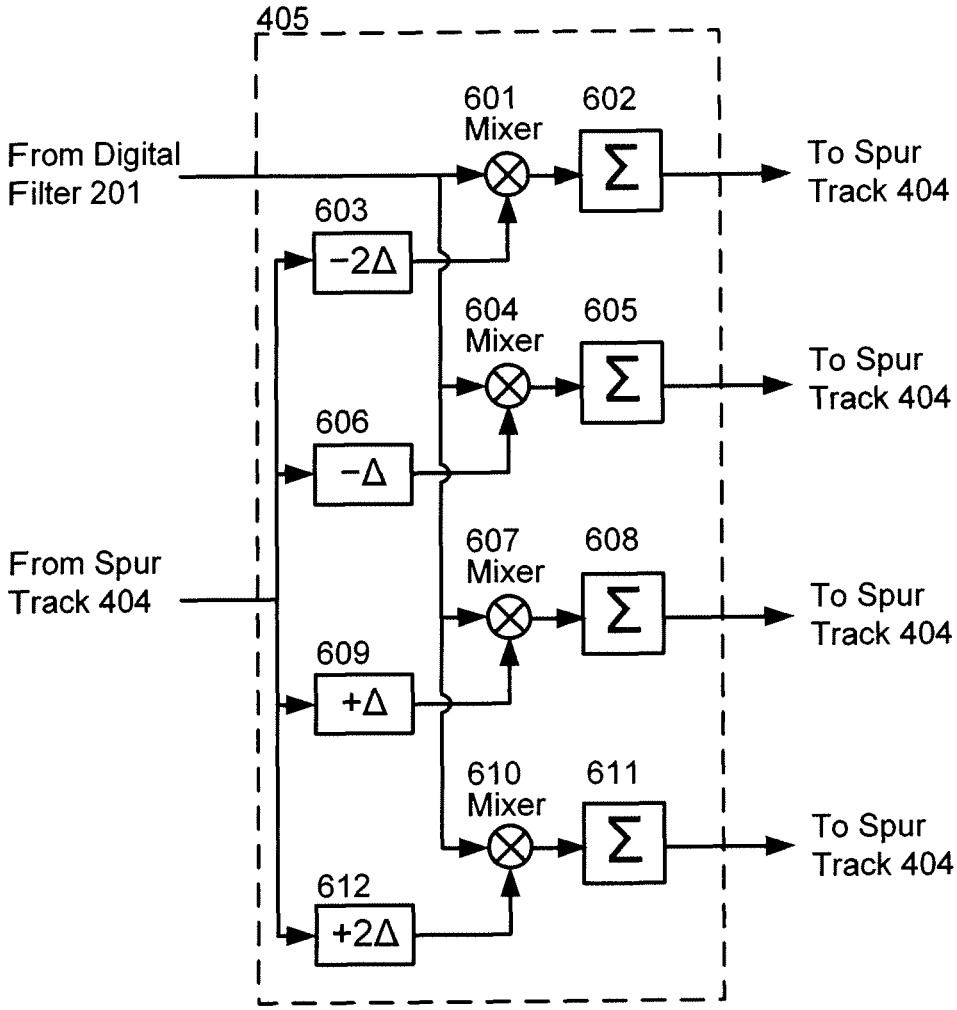
FIG. 6 illustrates an embodiment of an adjustable DFT block of FIG. 4.
Figure 7C:
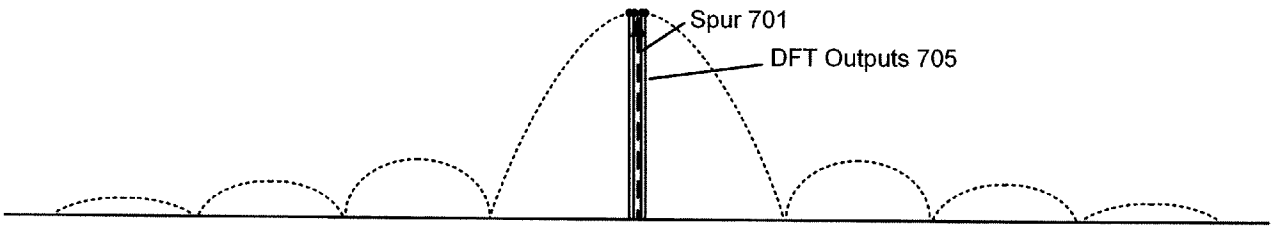
FIG. 7C illustrates a set of power spectrum values for DFT outputs calculated at frequencies near a narrowband interference spur.

FIG. 6 illustrates an embodiment of the computational blocks inside the DFT block 405 where a digital signal output from the digital filter 201 may be shifted by multiplying by a complex frequency $\exp\{-j\cdot 2\pi\cdot f_i\cdot n\cdot T_s\}$, where n may denote a time sample index and $T_s$ may equal the time interval between successive samples. The shift frequency $f_i=f_c+\Delta_f$ may be a coarse frequency $f_c$ determined by the spur tracking block 404 modified up or down by a fine adjustment $\Delta_f$. In the example in FIG. 6, a four point DFT may use fine frequency adjustments of −2Δ, −Δ, +Δ, and +2Δ in blocks 603, 606, 609 and 612 respectively. FIG. 7C illustrates how the DFT outputs 705 of the DFT block 405 may provide a set of closely spaced estimates for the narrowband interference spur 701. These DFT outputs 705 may be communicated to the spur tracking block 404 to provide a finer estimate of the spur center frequency.

As indicated in FIG. 4, an output of the spur tracking block 404 within the spur detection block 206 may be communicated to the spur cancellation block 202. FIG. 3 illustrates an exemplary embodiment of processing blocks with the spur cancellation block 202. The input signal from the digital filter 201 may be down mixed in frequency by a mixer 301 to shift the spur energy to DC using information from the spur detection block 206. A high pass filter 301 at DC in the spur cancellation block 202 may attenuate the input signal at frequencies on and/or near the detected spur. The spur detection block 206 may provide information to the high pass filter 301 that may be used to determine the frequency width and shape of the high pass filter 302. The output of the high pass filter 302 may then be up mixed in frequency by a mixer 303 providing an output digital signal with some or all of the spur interference removed. The output digital signal may then be communicated to a digital filter 203 for additional processing before the FFT block 104.

Figure 5:
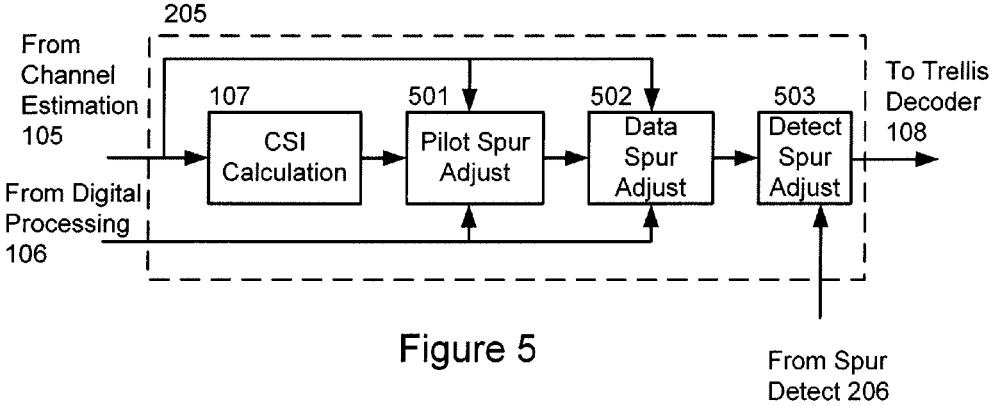
FIG. 5 illustrates an embodiment of a modified CSI calculation block of FIG. 2.

As also indicated in FIG. 4, an output of the spur tracking block 404 may be provided to the modified CSI calculation block 205. This output may include, but not be limited to, the location of one or more interference spur frequencies. FIG. 5 illustrates an exemplary embodiment of processing blocks within the modified CSI calculation block 205. An estimate of the communication channel transfer characteristic may be provided from the channel estimation block 105 to a CSI calculation block 107 that may output an initial CSI. A pilot spur adjustment block 501 may receive an output from the digital processing block 106 that may represent the received symbols at each sub-carrier corrected by the estimated channel transfer characteristic provided by the channel estimation block 105. The pilot spur adjustment block 501 may estimate the noise level at each pilot sub-carrier to determine whether the sub-carrier's CSI may be adjusted. Note from Equation (1) above that given a channel estimate $\hat{H}_k$ and a known transmit symbol $X_k$ for a sub-carrier k, one may calculate the noise $N_k=Y_k-\hat{H}_kX_k$ from the received symbol $Y_k$ or equivalently using Equation (2) from the zero-forcing estimate of the transmit symbol $\hat{X}_k$ because of the equality $Y_k=\hat{H}_k\hat{X}_k$. Defining an error $e_k$ at sub-carrier k as $e_k=\hat{X}_k-X_k$, note that a power $P_{N,k}$ of the noise at sub-carrier k may be accumulated over a number of successive FFT outputs as $$P_{N,k} = \sum_m \{|\hat{H}_{m,k}|^2 |e_{m,k}|^2\}.$$

If the noise power $P_{N,k}$ at a pilot sub-carrier k is high compared against the average noise power over the other sub-carriers, then a CSI value at sub-carrier value may be adjusted accordingly, e.g. muted to zero. Because each pilot sub-carrier carries known transmit symbols, a receiver may determine a noise level precisely at the pilot sub-carrier. Accumulating these pilot sub-carrier noise levels over time may enable one to detect and adjust the CSI to account for that detected interference.

The CSI, after modification by the pilot spur adjustment block 501, may be transferred to a data spur adjustment block 502 that may calculate the presence of spurs on the data sub-carriers. As the transmitted symbol may not be known for a data sub-carrier, the noise level may not be estimated as done for the pilot sub-carriers. Instead a magnitude of the estimated transmit symbol $|\hat{X}_k|$ may be used together with a magnitude of the channel estimate $|\hat{H}_k|$ as follows. For each sub-carrier k, determine an energy value $E_k$ by accumulating over a succession of OFDM symbols a magnitude of the channel estimate $|\hat{H}_{k,m}|$ if a magnitude of the estimated transmit symbol $|\hat{X}_{k,m}|$ exceeds a threshold T, where m indicates an index for the OFDM symbol. Subsequently compare a set of largest energy values $E_{max}$ measured across all sub-carriers to the average energy value of the other sub-carriers or to the energy of a set of adjacent sub-carriers to detect a spur. The comparison may use threshold criteria as described above for the spur detection block 206. The data adjustment spur detection calculation may be written as follows.

$\hat{X}_{m,k}$=Estimated transmit symbol for $m^{th}$ OFDM symbol and sub-carrier $k$ $$Z_{m,k}=1 \text{ if } |\hat{X}_{m,k}|>T, \ =0 \text{ otherwise}$$

$$E_k = \sum_m Z_{m,k}|\hat{H}_{m,k}|$$

$$E_{max}=\max\{E_k\}$$

After modification by the data spur adjustment block 502, the CSI may be adjusted by a spur detection adjustment block 503 that may receive information about the location and magnitude of one or more interference spurs from the spur detection block 206. The CSI may be adjusted at sub-carriers on or near one or more of the detected interference spurs. Thus three separate spur estimation adjustments may be made to the CSI prior to input to the trellis decoder 108.

Although illustrative embodiments of the invention have been described in detail herein with reference to the accompanying figures, it is to be understood that the invention is not limited to those precise embodiments. For example, the spur detection, spur cancellation and CSI adjustments described for a wireless multiple sub-carrier communication system may also apply to a wire-line multiple sub-carrier communication system. The embodiments described herein are not intended to be exhaustive or to limit the invention to the precise forms disclosed. As such, many modifications and variations will be apparent. Accordingly, it is intended that the scope of the invention be defined by the following Claims and their equivalents.

The invention claimed is:

1. A spur detection and spur cancellation apparatus in a multiple sub-carrier digital communication receiver, the spur detection and spur cancellation apparatus including:

a spur detection block that estimates, using a plurality of Fourier transforms, a coarse frequency location and a fine frequency location of a narrowband interference spur in a received digital signal that includes a plurality of sub-carriers; and a spur cancellation block that attenuates the narrowband interference spur estimated by the spur detection block in the received digital signal, wherein the spur cancellation block includes one or more mixers and one or more digital filters that attenuate the narrowband interference spur in the received digital signal estimated by the spur detection block.

2. The apparatus of claim 1 wherein the spur detection block includes:

a mixer to shift the received digital signal by one or more fractions of a spacing of the plurality of sub-carriers to form a set of shifted received digital signals;

a fast Fourier transform (FFT) to calculate a first set of discrete frequency domain spectra from the set of shifted received digital signals; and a spur tracking block to determine the coarse frequency location of the narrowband interference spur from the first set of discrete frequency domain spectra.

3. The apparatus of claim 2 wherein:

the spur detection block further includes a discrete Fourier transform (DFT) that calculates a second set of discrete frequency domain spectra from the received digital signal; and the spur tracking block further determines the fine frequency location of the narrowband interference spur using the coarse frequency location estimate of the narrowband interference spur and the second set of discrete frequency domain spectra.

4. The apparatus of claim 1 further including a channel state information calculation block that includes a spur detection adjustment block that adjusts a channel state information metric based on an estimated frequency location of the narrowband interference spur estimated by the spur detection block.

5. The apparatus of claim 4 wherein the channel state information calculation block further includes a pilot spur adjustment block that adjusts the channel state information metric based on an estimate of narrowband interference measured on a pilot sub-carrier.

6. The apparatus of claim 4 wherein the channel state information calculation block further includes a data spur adjustment block that adjusts the channel state information metric based on an estimate of narrowband interference measured on a data sub-carrier.

7. The apparatus of claim 1 wherein the spur detection block compares one or more received power metrics in one or more received sub-carriers to estimate the coarse frequency location of the narrowband interference spur.

8. The apparatus of claim 1 wherein the spur detection block compares one or more received power metrics in one or more received sub-carriers to an average power metric for a plurality of received sub-carriers to estimate the coarse frequency location of the narrowband interference spur.

9. A method for spur detection and spur cancellation in a multiple sub-carrier digital communication system including:

receiving a digital communication signal comprising a plurality of sub-carriers;

estimating a coarse frequency location and a fine frequency location of a narrowband interference spur by calculating a plurality of Fourier transforms based on the received digital communication signal; and attenuating the narrowband interference spur in the received digital communication signal, wherein attenuating the narrowband interference spur in the received digital communication signal includes:

shifting the received digital communication signal using one or more mixers and an estimated frequency location of the narrowband interference spur; and applying one or more digital filters to attenuate the narrowband interference spur in the received digital communication signal.

10. The method of claim 9 wherein estimating the coarse frequency location of the narrowband interference spur includes shifting the received digital communication signal by one or more fractions of a spacing of the plurality of sub-carriers to generate a set of shifted received digital communication signals;

calculating one or more fast Fourier transforms (FFT) of the set of shifted received digital communication signals to generate a set of discrete frequency spectra; and generating a coarse frequency location estimate of the frequency location of the narrowband interference spur using the set of discrete frequency spectra.

11. The method of claim 10 wherein estimating the fine frequency location of the narrowband interference spur includes generating a fine frequency location estimate of the narrowband interference spur by calculating one or more discrete Fourier transforms (DFT) of the received digital communication signal using the coarse frequency location estimate of the frequency location of the narrowband interference spur.

12. The method of claim 9 further including adjusting a channel state information metric based on the estimated frequency location of the narrowband interference spur.

13. The method of claim 12 further including estimating a narrowband interference value on a pilot sub-carrier and adjusting the channel state information metric based on the estimated narrowband interference value on the pilot sub-carrier.

14. The method of claim 12 further including estimating a narrowband interference value on a data sub-carrier and adjusting the channel state information metric based on the estimated narrowband interference value on the data sub-carrier.

15. The method of claim 9 wherein estimating the coarse frequency location of the narrowband interference spur includes comparing one or more received power metrics in one or more received sub-carriers.

16. The method of claim 9 wherein estimating the coarse frequency location of the narrowband interference spur includes comparing one or more received power metrics in one or more received sub-carriers to an average power metric for a plurality of received sub-carriers.

* * * * *